US008424845B2

(12) United States Patent
Cole

(10) Patent No.: US 8,424,845 B2
(45) Date of Patent: Apr. 23, 2013

(54) HAMMER AND CROWBAR WITH ADJUSTABLE CLAW

(75) Inventor: Charles A. Cole, Wylie, TX (US)

(73) Assignee: Indexable Tools, LLC

( * ) Notice: Subject to any disclaimer, the term of this patent is extended or adjusted under 35 U.S.C. 154(b) by 571 days.

(21) Appl. No.: 12/506,800

(22) Filed: Jul. 21, 2009

(65) Prior Publication Data

US 2010/0019214 A1 Jan. 28, 2010

Related U.S. Application Data

(60) Provisional application No. 61/135,413, filed on Jul. 21, 2008.

(51) Int. Cl.
*B25C 11/00* (2006.01)

(52) U.S. Cl.
USPC ..... 254/26 R; 254/22; 254/25; 254/27; 81/20; 81/177.7; 81/177.8

(58) Field of Classification Search ..... 254/22, 254/25, 26 R, 27; 81/20–26, 177.7, 177.8, 81/177.9
See application file for complete search history.

(56) References Cited

U.S. PATENT DOCUMENTS

| | | | | |
|---|---|---|---|---|
| 151,315 | A | 5/1874 | Rowe | |
| 624,643 | A | 5/1899 | Gaylor | |
| 662,966 | A | 12/1900 | Robertson | |
| 879,525 | A * | 2/1908 | Cook | 81/177.8 |
| 928,375 | A | 7/1909 | Fricke | |
| 1,077,575 | A | 11/1913 | Wutke | |
| 1,109,032 | A | 9/1914 | Berstead | |
| 1,217,217 | A | 2/1917 | Reagan, Jr. | |
| 1,286,506 | A | 12/1918 | Berry | |
| 1,292,886 | A * | 1/1919 | Rolston | 7/146 |
| 1,355,455 | A | 10/1920 | Doughty | |
| 1,431,389 | A | 10/1922 | Frisz | |
| 1,445,263 | A * | 2/1923 | Asper | 254/15 |
| 1,568,442 | A | 1/1926 | Carver | |
| 1,840,685 | A | 1/1932 | Witherup | |
| 2,082,901 | A * | 6/1937 | Palmu | 254/22 |

(Continued)

FOREIGN PATENT DOCUMENTS

| | | | |
|---|---|---|---|
| WO | WO-9534408 | A1 | 12/1995 |
| WO | WO-9848178 | A1 | 10/1998 |
| WO | WO-9916584 | A1 | 4/1999 |

OTHER PUBLICATIONS

U.S. Patent and Trademark office action cited in copending U.S. Appl. No. 11/356,601, May 29, 2008.

(Continued)

*Primary Examiner* — George Nguyen

(57) ABSTRACT

An embodiment of a hand tool comprising: a fixed hand tool, such as a hammer or a crowbar, with respect to a handle; a pivoting mechanism; and a claw being coupled to a handle via the pivoting mechanism is described. In another embodiment, the hand tool comprises a fixed tool with respect to a handle, such as a hammer or a crowbar; a coupling mechanism; a claw being coupled to a handle via the coupling mechanism; the coupling mechanism further comprising a splined pin assembly adapted to couple the claw and a handle so as to permit the claw to pivot with respect to the handle, is described. Various pivoting mechanisms including splined pin assemblies and locking pin mechanisms are described.

9 Claims, 17 Drawing Sheets

U.S. PATENT DOCUMENTS 2,325,227 A * 7/1943 Chaddock ..... 254/25
2,330,092 A * 9/1943 Vanasse ..... 254/25
2,420,132 A 5/1947 Gryiuck
2,603,325 A 7/1952 Pickard
2,638,677 A 5/1953 Sheriff
2,671,367 A 3/1954 Modin
2,691,316 A 10/1954 Brame
2,708,855 A 5/1955 Fish
2,921,773 A 1/1960 Hoelzer
3,002,409 A 10/1961 Jones
3,039,339 A 6/1962 Hanson
3,119,591 A 1/1964 Malecki
3,175,436 A 3/1965 Coleman
3,188,895 A 6/1965 Jones
3,270,597 A 9/1966 Neff et al.
3,314,318 A 4/1967 Shoults
3,376,768 A 4/1968 Fortunato
3,550,486 A 12/1970 Edwards
3,733,936 A 5/1973 Flynn
3,779,107 A 12/1973 Avery
3,854,832 A 12/1974 Cowper
4,027,558 A 6/1977 Fish
4,145,124 A 3/1979 Weisgerber
4,184,783 A 1/1980 Hall
4,244,237 A 1/1981 Sprunger
4,270,417 A 6/1981 Tesoro
4,281,601 A 8/1981 Overman
4,406,186 A 9/1983 Gummow
4,479,409 A 10/1984 Antonius
4,520,697 A 6/1985 Moetteli
4,543,007 A 9/1985 Quiogue
4,582,445 A 4/1986 Warshawsky
4,596,167 A 6/1986 White, Jr.
4,614,452 A 9/1986 Wang
4,619,540 A 10/1986 Day et al.
4,657,428 A 4/1987 Wiley
4,711,596 A 12/1987 Bruderer
4,747,328 A 5/1988 Howard
4,774,862 A 10/1988 Scull
4,794,829 A 1/1989 Mesenhoeller
4,800,785 A 1/1989 Christensen
4,805,494 A * 2/1989 Santoro ..... 81/20
4,901,608 A 2/1990 Shieh
4,921,271 A 5/1990 Berry et al.
4,929,113 A 5/1990 Sheu
4,982,732 A 1/1991 Morris
4,991,470 A 2/1991 Singleton
4,993,862 A 2/1991 Pelta
5,039,118 A 8/1991 Huang
5,056,805 A 10/1991 Wang
5,062,179 A 11/1991 Huang
5,123,768 A 6/1992 Franklin
5,197,817 A 3/1993 Wood et al.
5,280,738 A * 1/1994 Liou ..... 81/20
5,326,186 A 7/1994 Nyberg
5,386,747 A 2/1995 Grover
5,419,221 A 5/1995 Cole
5,471,899 A 12/1995 Twomlow
5,503,048 A 4/1996 Moon
5,522,287 A 6/1996 Chiang
5,564,852 A 10/1996 Maxwell et al.
5,581,838 A 12/1996 Rocco
5,674,024 A 10/1997 Daumal Castellon
5,694,818 A 12/1997 Nickipuck
5,695,172 A * 12/1997 Hreha ..... 254/25
5,775,184 A 7/1998 Cole
5,820,288 A 10/1998 Cole
5,860,337 A 1/1999 Janssen
5,871,204 A * 2/1999 Spirer ..... 254/26 R
5,879,100 A 3/1999 Winkler
5,911,800 A 6/1999 Roberts et al.
5,941,141 A 8/1999 Whitley
6,000,299 A 12/1999 Cole
6,032,555 A 3/2000 Whitley
6,161,982 A 12/2000 Cole
6,216,565 B1 4/2001 McCann
6,240,809 B1 6/2001 Sasarak
6,257,553 B1 * 7/2001 Khachatoorian ..... 254/25
6,324,947 B2 12/2001 Jarvis
6,412,374 B1 7/2002 Hsieh
6,488,266 B2 * 12/2002 Macor ..... 254/25
6,752,380 B1 * 6/2004 Taylor et al. ..... 254/25
6,840,141 B2 1/2005 Cole
6,895,839 B1 * 5/2005 Hsien ..... 81/177.8
6,948,700 B2 * 9/2005 Wood ..... 254/25
7,025,331 B2 * 4/2006 Whelan ..... 254/25
7,039,993 B1 * 5/2006 Smith et al. ..... 29/235
7,082,862 B2 8/2006 Lee
7,156,003 B2 1/2007 Cole
7,168,346 B2 1/2007 Lin
7,171,876 B2 2/2007 Chen
7,237,463 B1 7/2007 Lee
7,278,626 B1 * 10/2007 Chang ..... 254/25
7,591,208 B2 9/2009 Cole
7,628,382 B2 * 12/2009 Cole ..... 254/25
2004/0202506 A1 10/2004 Lazic et al.
2004/0226418 A1 11/2004 Honniball
2005/0097994 A1 5/2005 Liao
2006/0260445 A1 * 11/2006 Cole ..... 81/177.8
2007/0169590 A1 7/2007 Cole

OTHER PUBLICATIONS

U.S. Patent and Trademark office action cited in copending U.S. Appl. No. 11/356,601, Jan. 5, 2009.
U.S. Patent and Trademark office action cited in copending U.S. Appl. No. 11/434,701, Jun. 1, 2007.
U.S. Patent and Trademark office action cited in copending U.S. Appl. No. 11/356,601, Sep. 18, 2009.

* cited by examiner

HAMMER AND CROWBAR WITH ADJUSTABLE CLAW

CROSS-REFERENCE TO RELATED APPLICATIONS

This application claims the benefit of U.S. Provisional Application No. 61/135,413, filed on Jul. 21, 2008. Both U.S. Provisional Application No. 61/135,413, filed on Jul. 17, 2008, and U.S. Provisional Application No. 61/072,618, filed on Apr. 1, 2008 are incorporated herein by reference.

STATEMENT REGARDING FEDERALLY SPONSORED RESEARCH

N/A

BACKGROUND OF THE INVENTION

1. Field of the Invention

This invention relates generally to hand tools, and more particularly to indexing hammers and crowbars.

2. Description of the Related Art

A hammer is known in the art to have a handle rigidly attached to a fixed hammer head and claw that is somewhat orthogonal to said handle. The claw can be used as a nail extractor having a slot into which the head of a nail can be inserted, and when a torque is applied to the handle, the nail can be caused to be removed. The claw is often in the form of a slotted v-cut therein adapted to allow a nail to be removed from a structure (e.g., wall, ceiling, floor). However, such hammers have claws that are fixed with respect to the hammer head, thus, in some situations (e.g., tight corners), making it difficult to position the claw to extract nails.

Similarly, a crowbar has a handle or a metal bar and a curved claw that is somewhat orthogonal to the handle or metal bar. The claw can be used as a nail extractor having a slot into which the head of a nail can be inserted, and when torque is applied to the handle or metal bar, the nail can be caused to be removed. As with the hammer, the claw is often in the form of a slotted v-cut therein adapted to allow a nail or a board to removed from a structure (e.g., wall, ceiling, floor). Such crowbars have claws that are fixed with respect to the handle or metal bar, thus, in some situations (e.g., tight corners), making it difficult to position the claw to extract nails or to remove boards.

Accordingly, a hammer with an adjustable claw is needed that allows the claw to be adjusted with respect to the hammer head to make it easier to position the claw to extract nails. Similarly, an adjustable, crowbar with an adjustable claw is needed that allows the claw to be adjusted with respect to the handle or metal bar to make it easier to position the claw.

BRIEF SUMMARY OF THE INVENTION

The present invention comprises a fixed hand tool such as a hammer head or a crow bar, and a claw being pivotally coupled to an first end of a handle thereof with an indexable, lockable pivoting mechanism that includes various splined pin assemblies and/or locking pin mechanisms. Although the term spline is used herein, such term is meant to include any type of regularly spaced ridges and troughs, such as teeth, anticlines, and/or notches, (whether having slopes, being acicular, agonic, beveled, elliptical or the like).

A first embodiment of the present invention comprises a hammer having a fixed striking surface such as a hammer head, as would be used as a striking surface on a first end of a handle and claw being pivotally coupled to the first end of handle thereof with an indexable, lockable pivoting mechanism including a splined pin assembly.

A second embodiment of the present invention comprises a hammer having a fixed striking surface such as a hammer head, as would be used as a striking surface on a first end of a handle and claw being pivotally coupled to the first end of handle thereof with an indexable, lockable pivoting mechanism that includes a locked pin assembly.

A third embodiment of the present invention comprises a hammer having a fixed striking surface such as a hammer head, as would be used as a striking surface on a first end of a handle and claw being pivotally coupled to the second end of handle thereof with an pivoting mechanism that includes the splined pin assembly as used in the first embodiment of the present invention.

A fourth embodiment of the present invention comprises a hammer having a fixed striking surface such as a hammer head, as would be used as a striking surface on a first end of a handle and claw being pivotally coupled to the first end of handle thereof with a pivoting mechanism that includes an extensible leverage member that extends from a bore in the tool head at the top of the first end of the handle. The extensible leverage member has a bore with teeth that are engaged by a locking mechanism at the tool head as so to lock the extensible leverage member in place.

A fifth embodiment of the present invention comprises a hammer having a fixed striking surface such as a hammer head, as would be used as a striking surface on a first end of a handle and a claw being pivotally coupled to the first end of the handle thereof with an indexable, lockable pivoting mechanism including a locking pin assembly.

A sixth embodiment of the present invention comprises a hammer having a fixed striking surface such as a hammer head, as would be used as a striking surface on a first end of a handle and a claw being pivotally coupled to the first end of the handle thereof with an indexable, lockable pivoting mechanism including a locking pin assembly.

A seventh embodiment of the present invention comprises a hammer having a fixed striking surface such as a hammer head, as would be used as a striking surface on a first end of a handle and a claw being pivotally coupled to the first end of the handle thereof with an indexable, lockable pivoting mechanism including a splined pin assembly and a locking pin mechanism.

An eighth embodiment of the present invention comprises a bar having a fixed prying surface such as a crow bar, as would be used as a prying surface on a second end of a handle and a claw being pivotally coupled to the first end of the handle thereof with an indexable, lockable pivoting mechanism that includes a splined pin assembly.

Still, other objects, features, and advantages of the present invention will be apparent from the following description of the preferred embodiments, given for the purpose of disclosure, and taken in conjunction with the accompanying drawings.

BRIEF DESCRIPTION OF THE DRAWINGS

For a further understanding of the nature and objects of the present inventions, reference should be made to the following detailed disclosure, taken in conjunction with the accompanying drawings, in which like parts are given like reference numerals, and wherein.

DETAILED DESCRIPTION OF PREFERRED EMBODIMENTS OF THE INVENTIONS

Figure 1A:
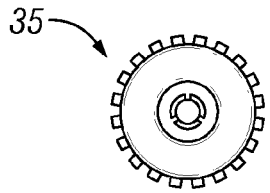
FIG. 1 is an end-view and a side-view of a splined pin of an embodiment of an adjustable hammer.

The present invention comprises a fixed hand tool such as a hammer head or a crow bar, and a claw being pivotally coupled to an end of a handle thereof with an indexable, lockable pivoting mechanism that includes various splined pin assemblies and/or locking pin mechanisms. Although the term spline is used herein, such term is meant to include any type of regularly spaced ridges and troughs, such as teeth, anticlines, and/or notches, (whether having slopes, being acicular, agonic, beveled, elliptical or the like). In the following embodiments, the hand tool may be made out of any suitable material. Preferably, the tool is made from a stainless steel material including 17-4 stainless and heat treated 4140 stainless.

As seen in FIGS. 1-17, a first embodiment of the present invention comprises a hammer 1 having a fixed striking surface 5 such as a hammer head 10, as would be used as a striking surface 5 on a first end 15 of a handle 20 and claw 25 being pivotally coupled to the first end 15 of handle 20 thereof with an indexable, lockable pivoting mechanism 30 that includes a splined pin assembly 35.

Figure 4:
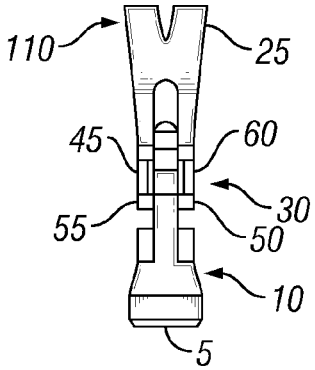
FIG. 4 is an end-view of an embodiment shown in FIG. 2.
Figure 5:
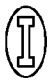
FIG. 5 is a cross-sectional view of a handle portion of an embodiment shown in FIG. 2.
Figure 8:
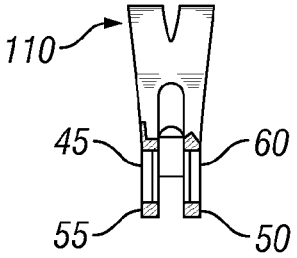
FIG. 8 is an outer curve, end-view of a claw portion of an embodiment shown in FIG. 2.
Figure 9:
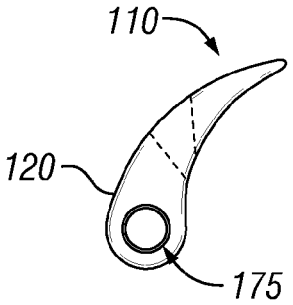
FIG. 9 is a side-view of a claw portion of an embodiment shown in FIG. 2.
Figure 10:
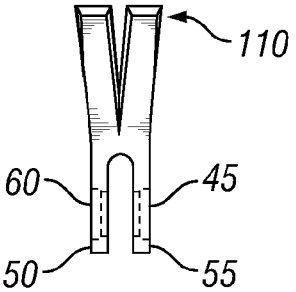
FIG. 10 is an inner curve, end-view of a claw portion of an embodiment shown in FIG. 2.
Figure 11:
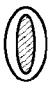
FIG. 11 is a cross-sectional view of a handle portion of an embodiment shown in FIG. 2.
Figure 12:
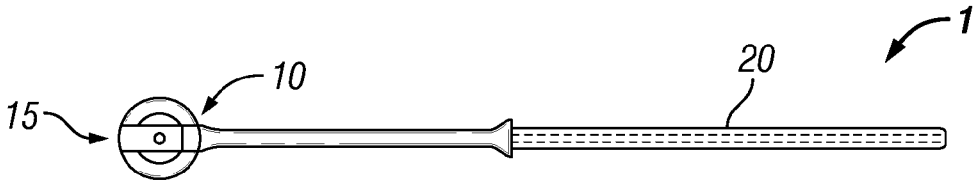
FIG. 12 is a rear-view of a fixed hammer portion of an embodiment shown in FIG. 2.
Figure 13:
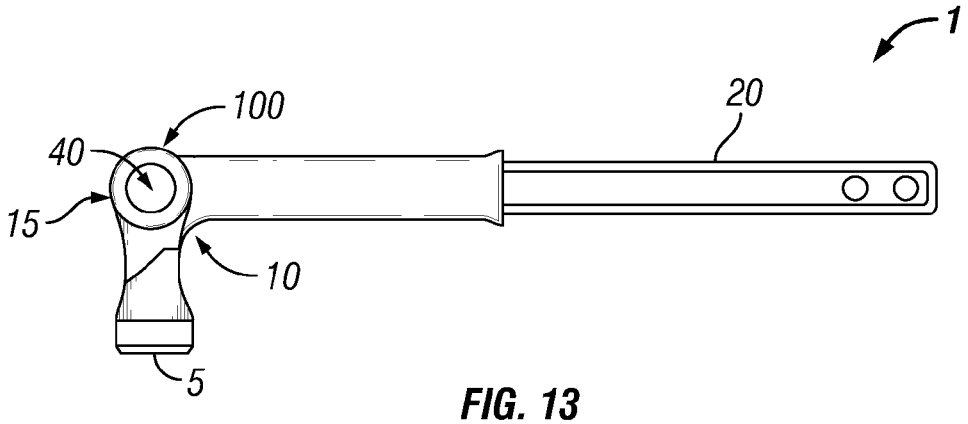
FIG. 13 is a side-view of a fixed hammer portion of an embodiment shown in FIG. 2.
Figure 14:
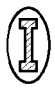
FIG. 14 is a cross-sectional view of a neck portion of an embodiment shown in FIG. 2.
Figure 15:
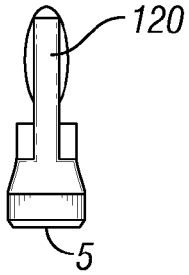
FIG. 15 is an end-view of a fixed hammer portion of an embodiment shown in FIG. 2.

As seen in FIGS. 8-10, the pivoting mechanism 30 of the first embodiment of the present invention comprises a first end 15 of the handle 20 having a first splined orifice 40, a claw 25 having an upper prong 50 with a second, partially splined orifice 45 and a lower prong 55 with a third, partially splined orifice 60, and a partially splined pin assembly 35 for insertion through the first 40, second 45 and third orifices 60. As seen in FIGS. 4 and 12-13, the first end 15 of the handle 20 includes therethrough the first splined orifice 40 and is positioned between the upper 50 and the lower prongs 55 of the claw 25 with the first splined orifice 40 coaxially aligned with the second 45 and third partially splined orifices 60 of the claw 25.

Figure 1B:
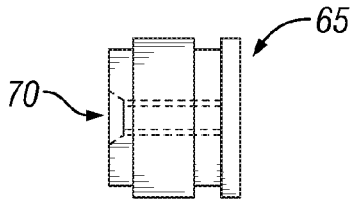
Figure 2:
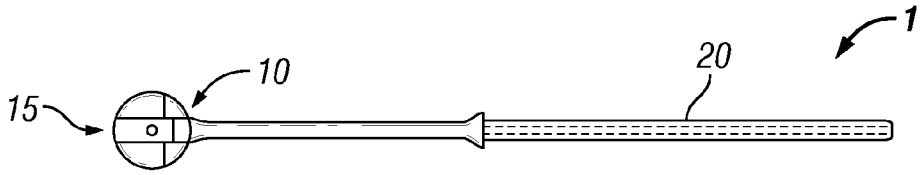
FIG. 2 is a rear-view of an embodiment of an adjustable hammer.
Figure 3:
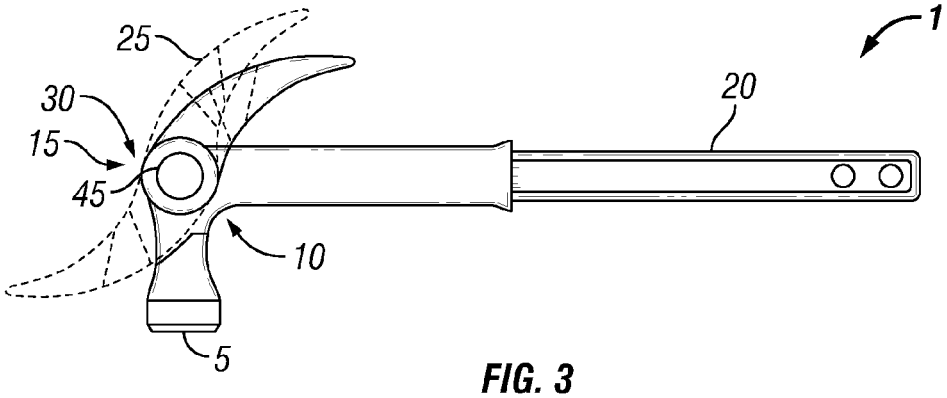
FIG. 3 is a side-view of an embodiment shown in FIG. 2.
Figure 6:
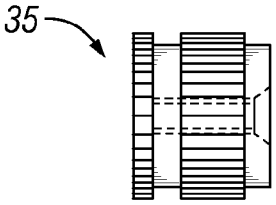
FIG. 6 is a side-view of a splined pin of an embodiment shown in FIG. 2.
Figure 7:
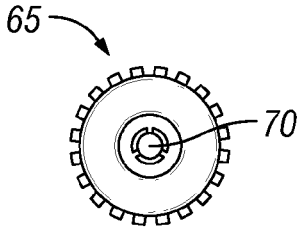
FIG. 7 is an end-view of a splined pin of the embodiment shown in FIG. 2.

The pivoting mechanism 30 includes the splined orifice 40 and the partially splined orifices 45 and 60 and a partially splined pin assembly 35 comprising a partially splined pin 65 (as seen in FIGS. 1, and 6-7) generally in the form of a cylinder (and to distinguish the parts of the splined pin, like a cylinder, the parts are referred to as a top, bottom (each in the form of a circle), and a side, which, if laid flat, would be in the form of a rectangle. The foregoing is used solely to provide a reference and shall not be deemed limiting in any way, as the "top" of the splined pin 65, when held, may or may not be "up" in a spatial sense). In a preferred embodiment, the partially, splined pin 65 has a first, square cut around a lateral circumference of the side of the splined pin 65 commencing at the edge of the top of the splined pin 65 and a second, square cut around a lateral circumference of the side of the splined pin 65 and located about ⅔ from the top of the splined pin 65 to the bottom of the splined pin 65. A first set of splines or teeth are cut longitudinally into the side of the splined pin 65 from the first and second set of lateral square cuts and extending to a depth equal to that of the first and second set of lateral square cuts, as seen in FIGS. 1 and 6-7. A second set of splines or teeth are cut longitudinally into the side of the splined pin 65 from the second lateral square cut and extending a depth equal to that of the first and second set of lateral square cuts, as seen in FIGS. 1 and 6-7, and extending longitudinally to the bottom of the partially splined pin 65.

Figure 16:
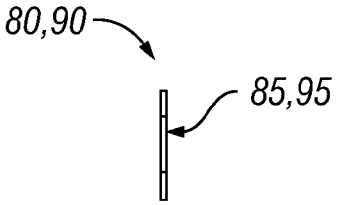
FIG. 16 is a side-view of a retaining cap of an embodiment shown in FIG. 2.
Figure 17:
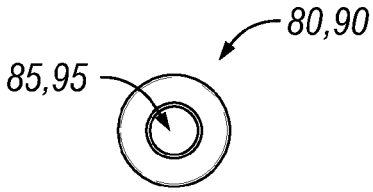
FIG. 17 is an end-view of a retaining cap of an embodiment shown in FIG. 2.

The partially splined pin 65 has a splined pin bore 70 therethrough and is threaded at both ends of the bore 70. As seen in FIGS. 16 and 17, the splined pin assembly 35 further comprises a first retaining cap 80 being a circular planar member having a centered, smooth tapered bore 85 therethrough, a first screw with a head to be disposed through the first retaining cap 80 to couple the first retaining cap 80, via the first screw, with one end of the threaded bore 70 of the splined pin 65, a second retaining cap 90 being a circular planar member having a centered, smooth tapered bore 95 therethrough; and a second screw with a tapered head to be disposed through the second retaining cap 90 to couple the second retaining cap 90 via the second screw with the other threaded bore 70 of the splined pin 65.

As seen in FIG. 13, the head of the hammer 10 has a hammer head bore 100 therethrough extending from the surface opposite to (and substantially parallel to) to the first splined orifice 40 in the first end 15 of the handle 20 into which a ball, spring and cap are inserted to provide the indexable aspects of the pivoting mechanism 30. When the claw 25 is unlocked by pressing the retaining cap 80 coupled to either the top or bottom of the splined pin assembly 35, the spring compresses and decompresses as the ball detents between each of the adjacent teeth or splines of the first set of teeth or splines (or the like) and the troughs thereinbetween, as seen in FIGS. 1 and 6. In operation, when the retaining cap 80 of the partially splined pin 65 is pressed to one extreme wherein the retaining cap 80 is flush against the outer end of, for example, the upper prong 50 (such that there is space between the other retaining cap 90 and the lower prong 55) and the claw 25 is in a locked position with respect to the fixed hammer head 10, then the first set of splines and second set of splines of the partially splined pin 65 are aligned with and engaged with the splines of the second 45 and third partially splined orifices 60 of the upper prong 50 and the lower prong 55 and with the first set of splines 40 of the first orifice 40 in the first end 15 of the handle 20. When the retaining cap 80 of the partially splined pin 65 is pressed to other extreme wherein the other retaining cap 90 is flush against the outer end of the lower prong 55 (such that there is space between the other retaining cap 80 and the upper prong 50) and the claw 25 is in an unlocked, indexable position with respect to the fixed hammer head 10, then the first and second cuts of the partially splined pin 65 are aligned with the splines of the second 45 and third partially splined orifices 60 of the upper prong 50 and the lower prong 55, respectively, allowing the claw 25 to rotate with respect to the tool handle 20 and hammer head 10.

The present invention further includes a tool handle or extension 20. In an alternative first embodiment of the present invention, the claw 25 can have a single prong with a single splined orifice therethrough, with the first end 15 of the handle 20 having a second and third prong with partially splined orifices adapted to receive the single prong (the second and third prongs being formed in the first end 15 of the handle 20 and extending laterally from the fixed hammer head 10), the first splined orifice of the first end 15 of the handle 20, with the partially, splined pin assembly 35 for insertion through said first, second and third orifices. Alterations can be made to the description hereinabove provided to adapt it to the alternative first embodiment. The present invention is intended to cover all such variations and configurations.

The splined pin assembly 35 of the first embodiment or the alternative first embodiment is disposed in the three splined orifices 40, 45, and 60 and is axially movable between an unlocked position and a locked position. The splined pin assembly 35 allows a user to move the splined pin 65 axially in the first 40, second 45 and third orifices 60 between the locked position and the unlocked position. The splines of the splined pin 65 are disposed in the first 40, and different portions of the second 45 and third orifices 60 in the locked position and the unlocked position.

Figure 18:
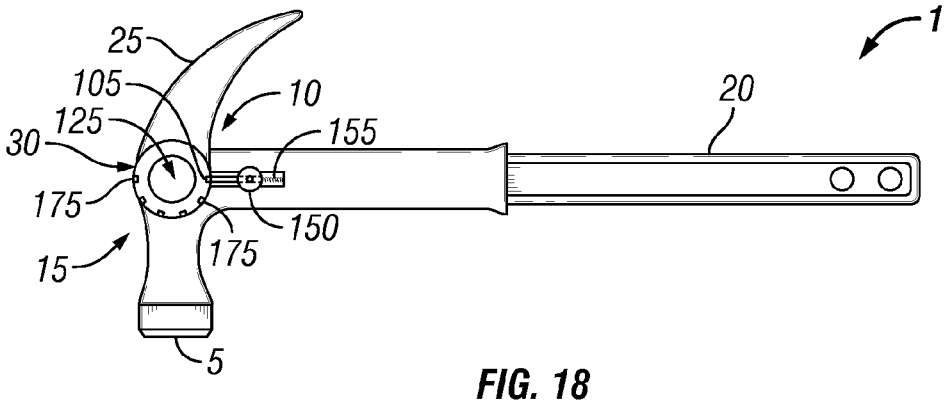
FIG. 18 is a side-view of an embodiment of an adjustable hammer.
Figure 19:
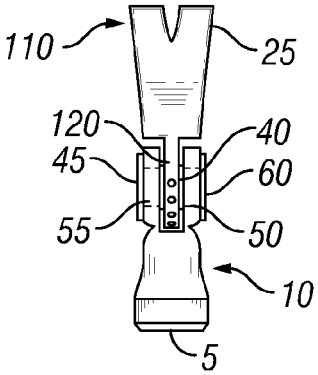
FIG. 19 is an end-view of an embodiment shown in FIG. 18.
Figure 20:
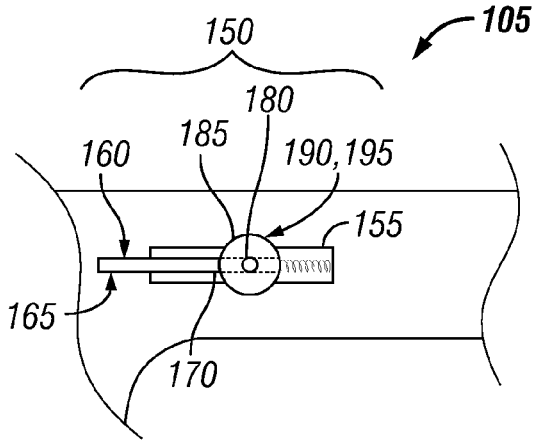
FIG. 20 is a detail-view for a locking mechanism of an embodiment shown in FIG. 18.

As seen in FIGS. 18-20, a second embodiment of the present invention comprises a hammer 1 having a fixed striking surface 5 such as a hammer head 10, as would be used as a striking surface 5 on a first end 15 of the handle 20 and claw 25 being pivotally coupled to the first end 15 of the handle 20 thereof with an indexable, lockable pivoting mechanism 30 that includes a locked pin assembly 105.

As seen in FIGS. 18 and 19, the pivoting mechanism 30 of the second embodiment of the present invention comprises a first end 15 of the handle 20 having a striking surface 5, such as a hammer head 10, an upper prong 50 and a lower prong 55, each having a circular orifice 45 and 60, respectively, having a smooth interior circumference, a claw 25 with v shaped claw portion 110 and a rounded center prong 120 having a substantially centered circular orifice 40 with a smooth interior circumference, the center prong 120 adapted to fit within and rotate with respect to the upper prong 50 and lower prong 55. A pin 125, being a substantially solid cylinder with a circumference slightly less than the circumference of the orifices 40, 45 and 60 through which it is inserted, is inserted axially through the orifices 40, 45 and 60 of the center 120, upper 50 and lower prongs 55, respectively. Each end 130 and 135 of the pin 125 includes a disk portion 140 and 145 that has a circumference greater than that of the orifices 40, 45 and 60 so as to secure the pin 125 axially within the orifices 40, 45 and 60. The pin 125 may also be held in place with a plurality of retaining rings.

As seen in FIGS. 18 and 20, a locking mechanism 150 serves to lock the rotating claw 25 with respect to the handle 20. The locking mechanism 150 is comprised of a handle bore 155 located longitudinally within a portion of the handle adapted to receive a locking pin 160, the locking pin 160 having a first end 165 and a second end 170, the first end 165 of the locking pin 160 being tapered and adapted to be received in and mated in one of a series of similarly tapered center prong bores 175 located concentrically along a curved face of the center prong 120 aligned with the locking pin 160. Toward the second end 170 of the locking pin 160 is a locking pin bore 180 located perpendicular to the locking pin 160, the locking pin bore 180 adapted to receive therethrough a release pin 185 having a disk 190 and 195 on each side adapted to permit a user to apply side pressure and downward force to the ends of the disks 190 and 195 on the release pin 185 thus causing the locking pin 160 be forced downward and hence to be released from the tapered center prong bore 175 in which it is located at that time. The release pin 185 may also be held in place with a plurality of retaining rings.

The locking pin 160 is caused to be forced upward into a tapered center prong bore 175 by a spring that is located below the locking pin 160 within the handle bore 155. The second end 170 of the locking pin 160 has a chamfer adopted to receive an end of the spring. The spring is normally in an extended position and is caused to be compressed by user force so as to cause the locking pin 160 to be released from tapered center prong bore 175. Then, the claw 25 can be rotated with respect to the handle 20. Once the user releases the side pressure and downward force on the release pin 185, the spring causes the locking pin 160 to return to an upward position. If the locking pin 160 is aligned with a tapered center prong bore 175, the claw 25 is locked into position. If not, then the first end 165 of the locking pin 160 rides along the smooth curved face of the center prong bore 175 until one of the tapered center prong bores 175 and the first end 165 of the locking pin 160 engage.

Figure 21:
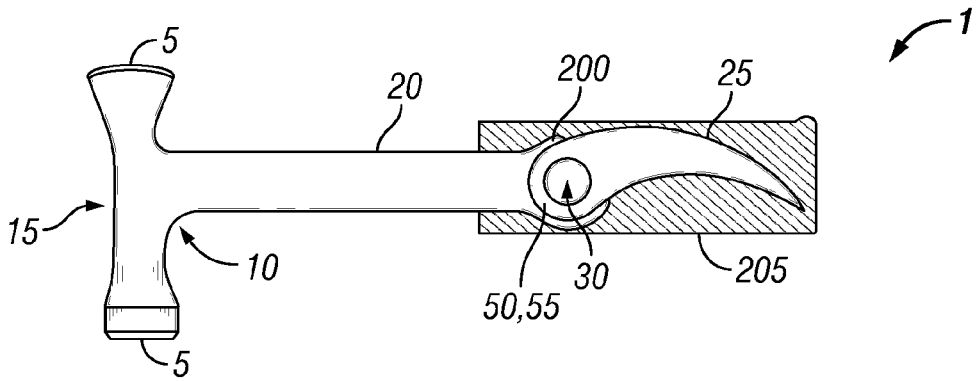
FIG. 21 is a sheathed side-view of an embodiment of an adjustable hammer.
Figure 22:
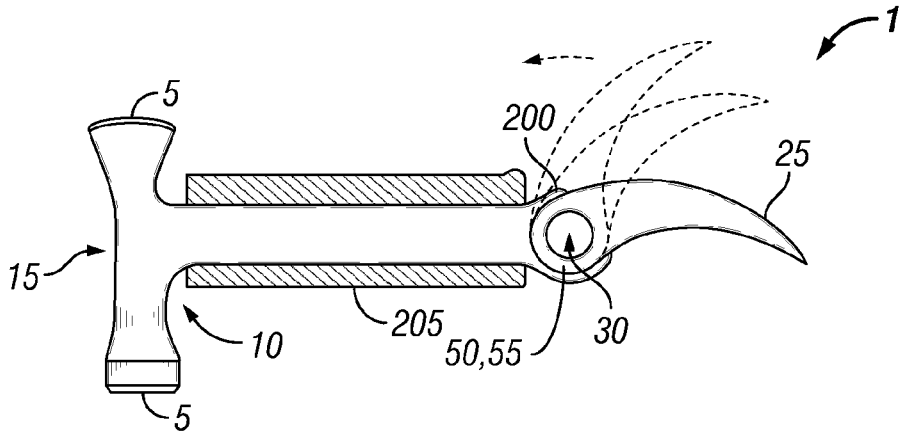
FIG. 22 is an unsheathed side-view of an embodiment shown in FIG. 21.
Figure 23:
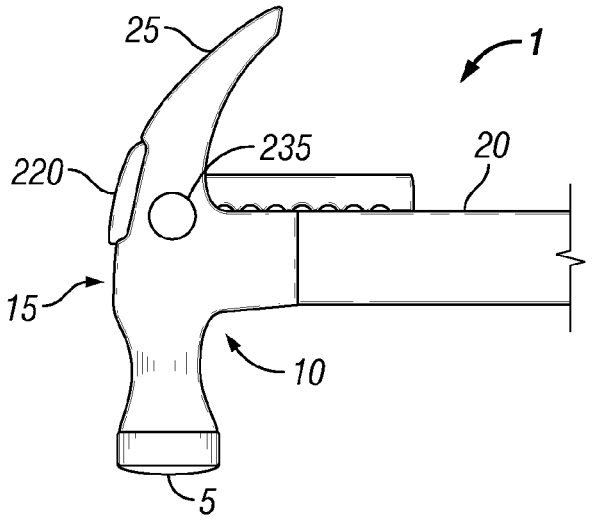
FIG. 23 is a retracted, partial side-view of an embodiment of an adjustable hammer.
Figure 24:
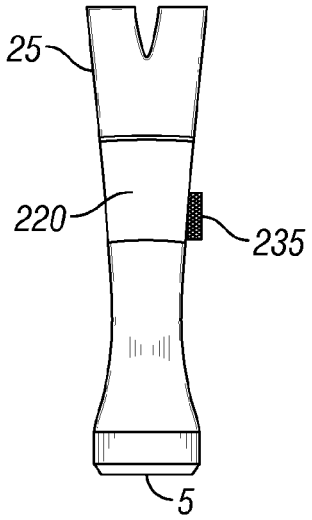
FIG. 24 is a retracted end-view of an embodiment shown in FIG. 23.
Figure 25:
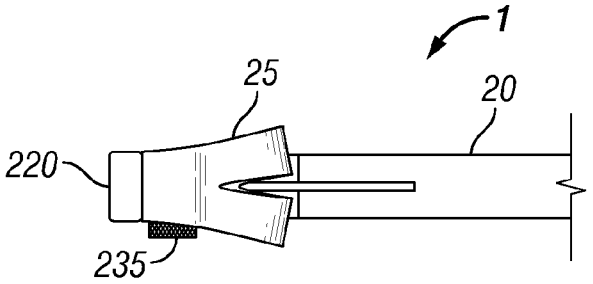
FIG. 25 is a retracted rear-view of an embodiment shown in FIG. 23.
Figure 26:
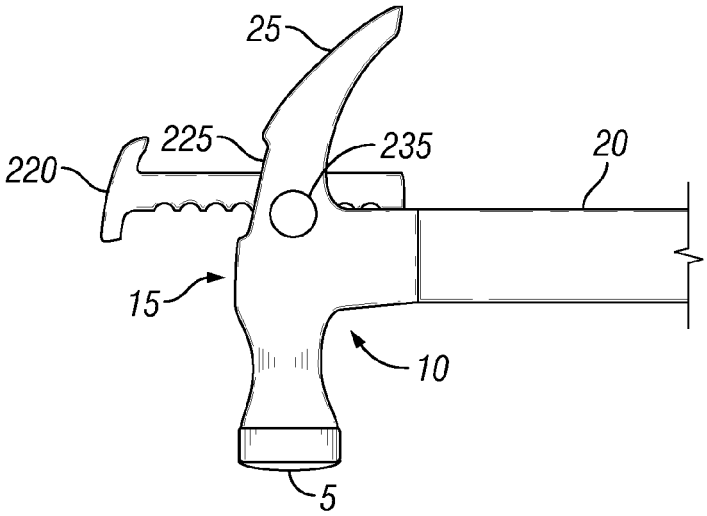
FIG. 26 is an extended, partial side-view of an embodiment shown in FIG. 23.

As seen in FIG. 21-22, a third embodiment of the present invention comprises a hammer 1 having a fixed striking surface 5 such as a hammer head 10, as would be used as a striking surface 5 on a first end 15 of a handle 20 and claw 25 being pivotally coupled to the second end 200 of the handle 20 thereof with an indexable, lockable pivoting mechanism 30 including a splined pin assembly 35 as used in the first embodiment of the present invention.

The second end 200 of the handle 20 has a slidable grip 205 that allows the grip 205 to be slid up the handle 20. In a preferred embodiment, the grip 205 has a length about ½ the length of the handle 20. The pivoting mechanism 30 is within the grip 205 at the second end 200 of the third embodiment of the present invention. The first end 15 of the handle 20 has a fixed striking surface 5, such as a hammer head 10. The second end 205 of the handle 20 has a first splined orifice 210, a claw 25 having an upper prong 50 with a second, partially splined orifice 45 and a lower prong 55 with a third, partially splined orifice 60. The second end 205 of the handle 20 includes therethrough the first splined orifice 210 and is positioned between the upper 50 and lower prongs 55 of the claw 25 with the first splined orifice 210 coaxially aligned with the second 45 and third partially splined orifices 60 of the claw 25.

In an alternative first embodiment of the present invention, the claw 25 can have a single prong with a single splined orifice therethrough, with the second end 200 of the handle 20 having a second and third prong with partially splined orifices adapted to receive the single prong (the second and third prongs being formed in the second end of the handle) the first splined orifice of the claw 25 being coaxially aligned with the second and third partially splined orifices of the second end 205 of the handle 20, with the partially, splined pin assembly 35 for insertion through said first, second and third orifices. Alterations can be made to the description hereinabove provided to adapt it to the alternative third embodiment. The present invention is intended to cover all such variations and configurations.

The splined pin assembly 35 of the third embodiment or the alternative third embodiment is disposed in the three splined orifices 210, 45 and 60 and is axially movable between an unlocked position and a locked position. The splined pin assembly 35 allows a user to move the splined pin 65 axially in the first 210, second 45 and third orifices 60 between the locked position and the unlocked position. The splines of the splined pin 65 are disposed in the first 210, and different portions of the second 45 and third orifices 60 in the locked position and the unlocked position.

As seen in FIGS. 23-26, a fourth embodiment of the present invention comprises a hammer 1 having a fixed striking surface 5 such as a hammer head 10, as would be used as a striking surface 5 on a first end 15 of a handle 20 and claw 25 being pivotally coupled to the first end 15 of handle 20 thereof with an indexable, lockable pivoting mechanism 30 that includes a splined pin assembly 35, and an extensible leverage member 220 that extends from a bore 225 in the hammer head 10 at the top of the first end 15 of the handle 20. The extensible leverage member 220 has a bore 225 with teeth that are engaged by a locking mechanism 235 at the hammer head 10 as so to lock the extensible leverage member 230 in place. When extended, the extensible leverage member 230 allows the user of the hammer 1 to remove, e.g., a nail without bending the nail.

As seen in FIGS. 27-41, a fifth embodiment of the present invention comprises a hammer 1 having a fixed striking surface 5 such as a hammer head 10, as would be used as a striking surface 5 on a first end 15 of a handle 20 and a claw 25 being pivotally coupled to the first end 15 of the handle 20 thereof with an indexable, lockable pivoting mechanism 240 including a locking pin assembly 105.

Figure 27A:
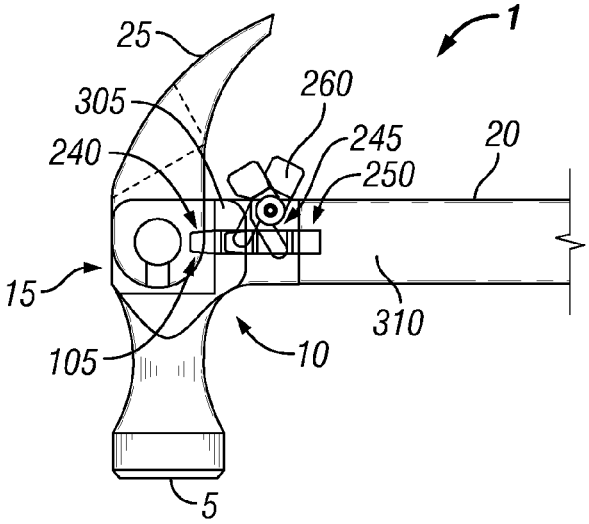
FIG. 27 is a partial side-view of an embodiment of an adjustable hammer.
Figure 27B:
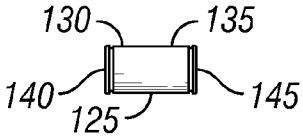
Figure 27C:
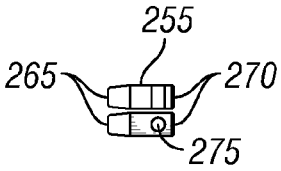
Figure 28:
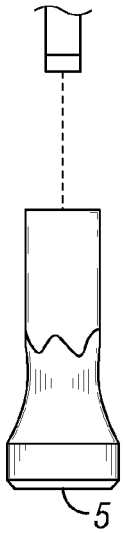
FIG. 28 is a partial end-view of an embodiment shown in FIG. 27.
Figure 29:
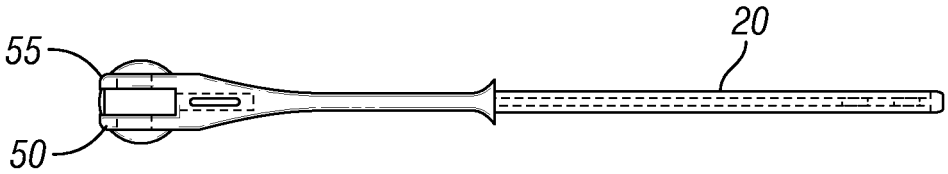
FIG. 29 is a rear view of an embodiment shown in FIG. 27.
Figure 30:
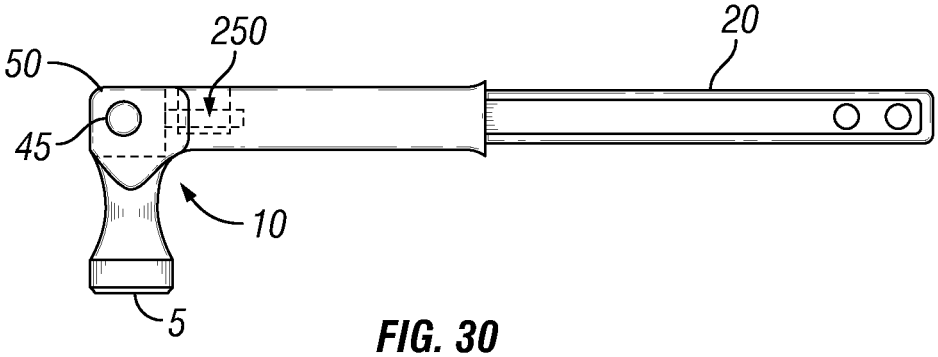
FIG. 30 is side-view of a fixed hammer portion of an embodiment shown in FIG. 27.
Figure 31:
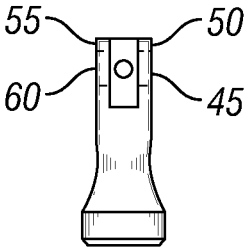
FIG. 31 is an end-view of a fixed hammer portion of an embodiment shown in FIG. 27.
Figure 32:
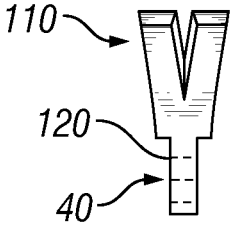
FIG. 32 is an outer curve, end-view of a claw portion of an embodiment shown in FIG. 27.
Figure 33A:
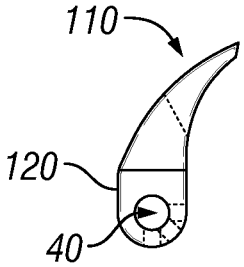
FIG. 33 is a side-view of a claw portion of an embodiment shown in FIG. 27.
Figure 33B:
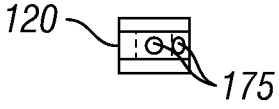
Figure 34:
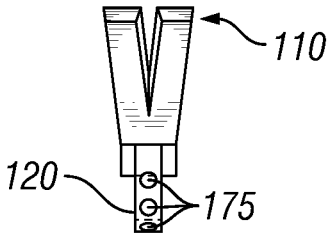
FIG. 34 is an inner curve, end-view of a claw portion of an embodiment shown in FIG. 27.
Figure 35:
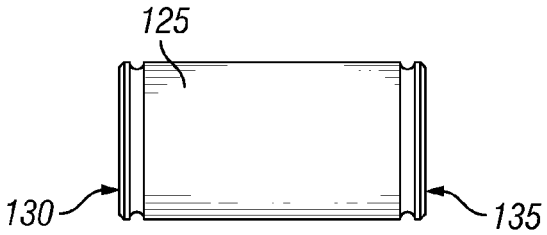
FIG. 35 is a side-view of a pin of an embodiment shown in FIG. 27.
Figure 36:
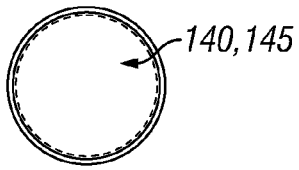
FIG. 36 is an end-view of a pin of an embodiment shown in FIG. 27.
Figure 37:
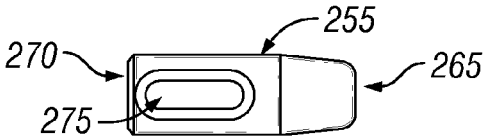
FIG. 37 is a bottom-view of a locking pin of an embodiment shown in FIG. 27.
Figure 38:
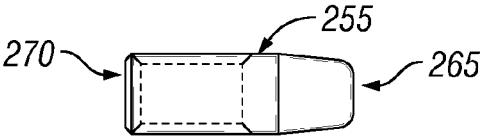
FIG. 38 is a top-view of the locking pin of an embodiment shown in FIG. 27.
Figure 39:
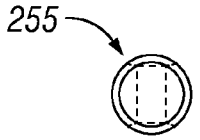
FIG. 39 is an end-view of a locking pin of an embodiment shown in FIG. 27.
Figure 40:
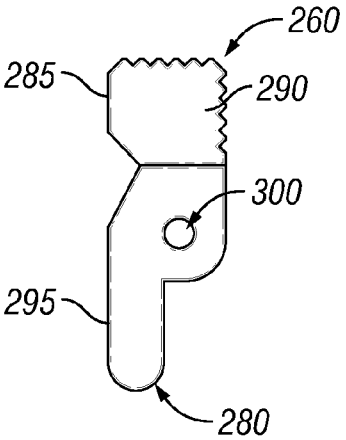
FIG. 40 is side-view of a locking lever of an embodiment shown in FIG. 27.
Figure 41:
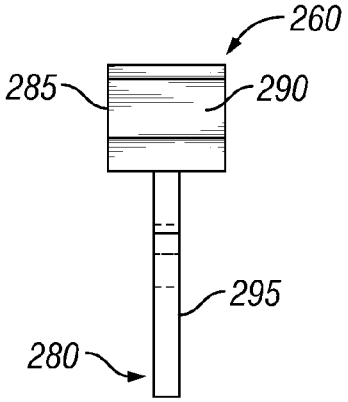
FIG. 41 is a top-view of a locking lever of an embodiment shown in FIG. 27.
Figure 42:
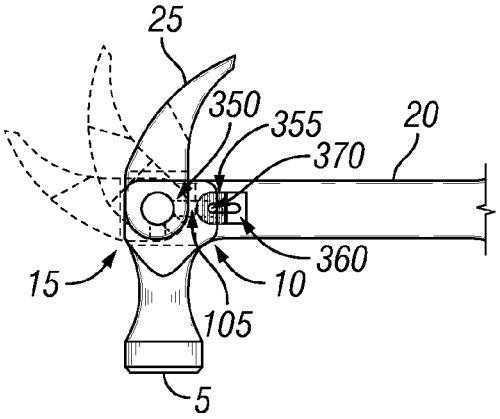
FIG. 42 is partial, side-view of an embodiment of an adjustable hammer.
Figure 43:
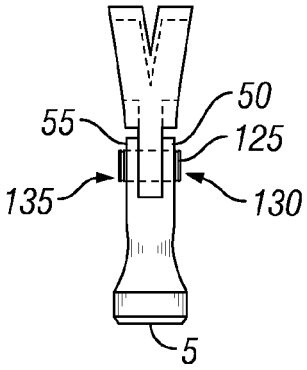
FIG. 43 is an end-view of an embodiment shown in FIG. 42.
Figure 44:
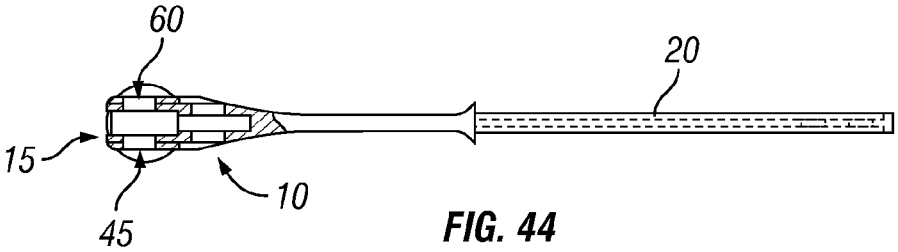
FIG. 44 is a rear-view of a fixed hammer portion of an embodiment shown in FIG. 42.
Figure 45:
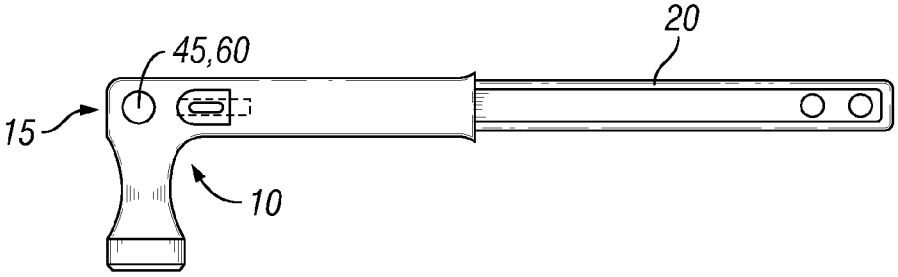
FIG. 45 is a side-view of a fixed hammer portion of an embodiment shown in FIG. 42.
Figure 46:
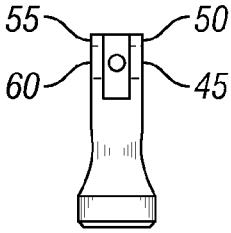
FIG. 46 is an end-view of a fixed hammer portion of an embodiment shown in FIG. 42.
Figure 47:
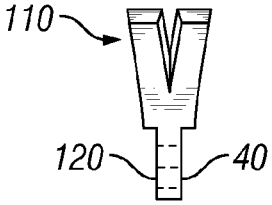
FIG. 47 is an outer curve, end-view of a claw portion of an embodiment shown in FIG. 42.
Figure 48A:
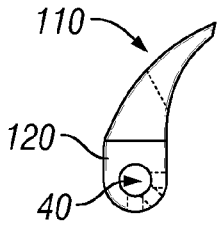
FIG. 48 is a side-view of a claw portion of an embodiment shown in FIG. 42.
Figure 48B:
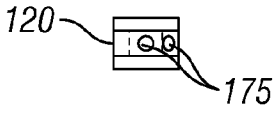
Figure 49:
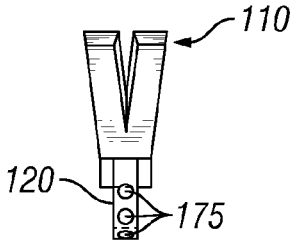
FIG. 49 is an inner curve, end-view of a claw portion of an embodiment shown in FIG. 42.
Figure 50:
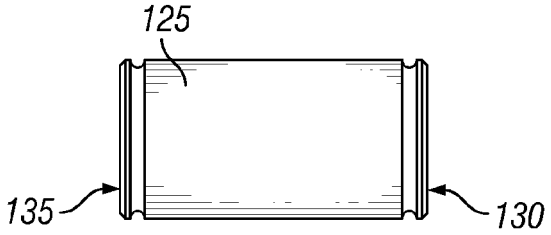
FIG. 50 is a side-view of a pin of an embodiment shown in FIG. 42.
Figure 51:
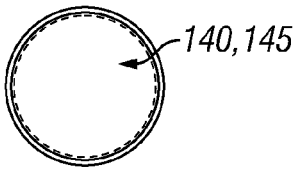
FIG. 51 is an end-view of a pin of an embodiment shown in FIG. 42.
Figure 52:
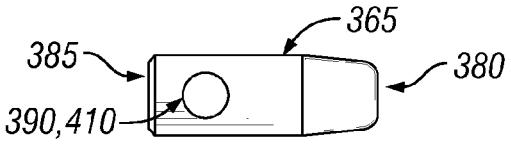
FIG. 52 is a side-view of a locking pin of an embodiment shown in FIG. 42.
Figure 53:
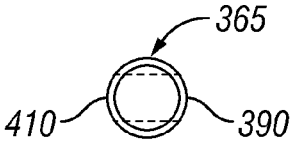
FIG. 53 is an end-view of a locking pin of an embodiment shown in FIG. 42.
Figure 54:
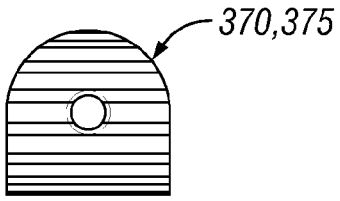
FIG. 54 is a top-view of a locking button of an embodiment shown in FIG. 42.
Figure 55:
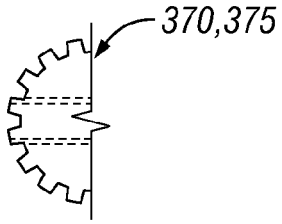
FIG. 55 is a side-view of a locking button of an embodiment shown in FIG. 42.

As seen in FIGS. 27 and 29-30, the pivoting mechanism 240 of the fifth embodiment of the present invention comprises a first end 15 of a handle 20 having a striking surface 5, such as a hammer head 10, and an upper 50 and lower prongs 55, each having a circular orifice 45 and 60, respectively, having a smooth interior circumference, a claw 25 with a v shaped claw portion 110 and a rounded center prong 120 having a substantially centered circular orifice 40 with a smooth interior circumference, the center prong 120 adapted to fit within and rotate with respect to the upper prong 50 and lower prong 55. A pin 125, being a substantially solid cylinder with a circumference slightly less than the circumference of the orifices 40, 45 and 60 through which it is inserted, is inserted axially through the orifices 40, 45 and 60 of the center 120, upper 50 and lower prongs 55, respectively. Each end 130 and 135 of the pin 125 includes a disk portion 140 and 145 that has a circumference greater than that of the orifices 40, 45 and 60 so as to secure the pin 125 axially within the orifices 40, 45 and 60. The pin 125 may also be held in place with a plurality of retaining rings.

As seen in FIGS. 27-41, a locking mechanism 245 serves to lock the rotating claw 25 with respect to the handle 20. The locking mechanism 245 is comprised of a handle bore 250 located longitudinally within a portion of the handle adapted to receive a locking pin 255 and a locking lever 260, the locking pin 255 having a first end 265 and a second end 270, the first end 265 of the locking pin 255 being tapered and adapted to be received in and mated in one of a series of similarly tapered center prong bores 175 located concentrically along a curved face of the center prong 120 aligned with the locking pin 255. Toward the second end 270 of the locking pin 255 is a locking pin bore 275 located perpendicular to the locking pin 255, the locking pin bore 275 adapted to receive therethrough a locking lever 260 having a first end 280 and a second end 285, the first end 280 of the locking lever 260 being tapered and adapted to be received in and mated in the locking pin bore 275 and the second end 285 of the locking lever 260 being a splined knob 290. Between the first 280 and second ends 285, the locking lever 260 further comprises a center prong 295 having a substantially centered circular orifice 300 with a smooth interior circumference; the prong 295 adapted to fit within and rotate with respect to the upper handle 305 and lower handle 310. A pin 315, being a substantially solid cylinder with a circumference slightly less than the circumference of the orifices 300, 320 and 325 through which it is inserted, is inserted axially through the orifices 300, 320 and 325 of the center 295, upper 305 and lower handle 310, respectively. Each end 330 and 335 of the pin 315 includes a disk portion 340 and 345 that has a circumference greater than that of the orifices 300, 320 and 325 so as to secure the pin 315 axially within the orifices 300, 320 and 325. The pin 315 may also be held in place with a plurality of retaining rings.

When a user applies a downward force to the splined knob 290 of the locking lever 260, the first end 280 of the locking lever 260 engages the locking pin bore 275 and causes the locking pin 255 to be forced upward and hence to be locked in the tapered center prong bore 175 in which it is located at that time. However, when a user applies an upward force to the splined knob 290 of the locking lever 260, the first end 280 of the locking lever cause the locking pin 255 to be forced downward and hence to be unlocked in the tapered center prong bore 175. Then, the claw 25 can be rotated with respect to handle 20.

The locking pin 255 is caused to be forced upward into a tapered center prong bore 175 by a spring that is located below the locking pin 255 within the handle bore 250. The second end 270 of the locking pin 255 has a chamfer adopted to receive an end of the spring. The spring is normally in an extended position and is caused to be compressed by user force so as to cause the locking pin 255 to be released from tapered center prong bore 175. Then, the claw 25 can be rotated with respect to the handle 20. Once the user releases the upward force on the splined knob 290 of the locking lever 260, the spring causes the locking pin 255 to return to an upward position. If the locking pin 255 is aligned with a tapered center prong bore 175, the claw 25 is locked into position. If not, then the first end 265 of the locking pin 255 rides along the smooth curved face of the center prong bore 175 until one of the tapered center prong bores 175 and the first end 265 of the locking pin 255 engage.

As seen in FIGS. 42-55, a sixth embodiment of the present invention comprises a hammer 1 having a fixed striking surface 5 such as a hammer head 10, as would be used as a striking surface 5 on a first end 15 of a handle 20 and a claw 25 being pivotally coupled to the first end 15 of the handle 20 thereof with an indexable, lockable pivoting mechanism 350 including a locking pin assembly 105.

As seen in FIGS. 42 and 43-45, the pivoting mechanism 350 of the sixth embodiment of the present invention comprises a first end 15 of a handle 20 having a striking surface 5, such as a hammer head 10, and an upper 50 and lower prongs 55, each having a circular orifice 45 and 60, respectively, having a smooth interior circumference, a claw 25 with a v shaped claw portion 110 and a rounded center prong 120 having a substantially centered circular orifice 40 with a smooth interior circumference, the center prong 120 adapted to fit within and rotate with respect to the upper 50 and lower prongs 55. A pin 125, being a substantially solid cylinder with a circumference slightly less than the circumference of the orifices 40, 45 and 60 through which it is inserted, is inserted axially through the orifices 40, 45 and 60 of the center 120, upper 50 and lower prongs 55, respectively. Each end 130 and 135 of the pin 125 includes a disk portion 140 and 145 that has a circumference greater than that of the orifices 40, 45 and 60 so as to secure the pin 125 axially within the orifices 40, 45 and 60. The pin 125 may also be held in place with a plurality of retaining rings.

As seen in FIGS. 42 and 48-55, a locking mechanism 355 serves to lock the rotating claw 25 with respect to the handle 20. The locking mechanism 355 is comprised of a handle bore 360 located longitudinally within a portion of the handle adapted to receive a locking pin 365 and a pair of locking buttons 370 and 375, the locking pin 365 having a first end 380 and a second end 385, the first end 280 of the locking pin 365 being tapered and adapted to be received in and mated in one of a series of similarly tapered center prong bores 175 located concentrically along a curved face of the center prong 120 aligned with the locking pin 365. Toward the second end 385 of the locking pin 365 is a locking pin bore 390 located perpendicular to the locking pin 365, the locking pin bore 390 adapted to receive therethrough a pin 395 having a first end 400 and a second end 405. A pin 395, being a substantially solid cylinder with a circumference slightly less than the circumference of the orifices 390, 410 and 415 through which it is inserted, is inserted axially through the orifices 390, 410 and 415 of the locking pin 365, upper 370 and lower locking buttons 375, respectively. Each end 400 and 405 of the pin 395 includes a disk portion 420 and 425 that has a circumference greater than that of the orifices 390, 410 and 415 so as to secure the pin 395 axially within the orifices 390, 410 and 415. The pin 395 may also be held in place with a plurality of retaining rings.

When a user applies an upward force to the upper locking button 370 and the lower locking button 375, the locking pin 365 is caused to be forced upward and hence to be locked in the tapered center prong bore 175 in which it is located at that time. However, when a user applies a downward force to the upper locking button 370 and lower locking button 375, the locking pin 365 to be forced downward and hence to be unlocked in the tapered center prong bore 175. Then, the claw 25 can be rotated with respect to handle 20.

The locking pin 365 is caused to be forced upward into a tapered center prong bore 175 by a spring that is located below the locking pin 365 within the handle bore 360. The second end 385 of the locking pin 365 has a chamfer adopted to receive an end of the spring. The spring is normally in an extended position and is caused to be compressed by user force so as to cause the locking pin 365 to be released from tapered center prong bore 175. Then, the claw 25 can be rotated with respect to the handle 20. Once the user releases the downward force on the upper locking button 370 and lower locking button 375, the spring causes the locking pin 365 to return to an upward position. If the locking pin 365 is aligned with a tapered center prong bore 175, the claw 25 is locked into position. If not, then the first end 380 of the locking pin 365 rides along the smooth curved face of the center prong bore 175 until one of the tapered center prong bores 175 and the first end 380 of the locking pin 365 engage.

As seen in FIGS. 56-70, a seventh embodiment of the present invention comprises a hammer 1 having a fixed striking surface 5 such as a hammer head 10, as would be used as a striking surface 5 on a first end 15 of a handle 20 and a claw 25 being pivotally coupled to the first end 15 of the handle 20 thereof with an indexable, lockable pivoting mechanism 430 including a splined pin assembly 35.

Figure 56:
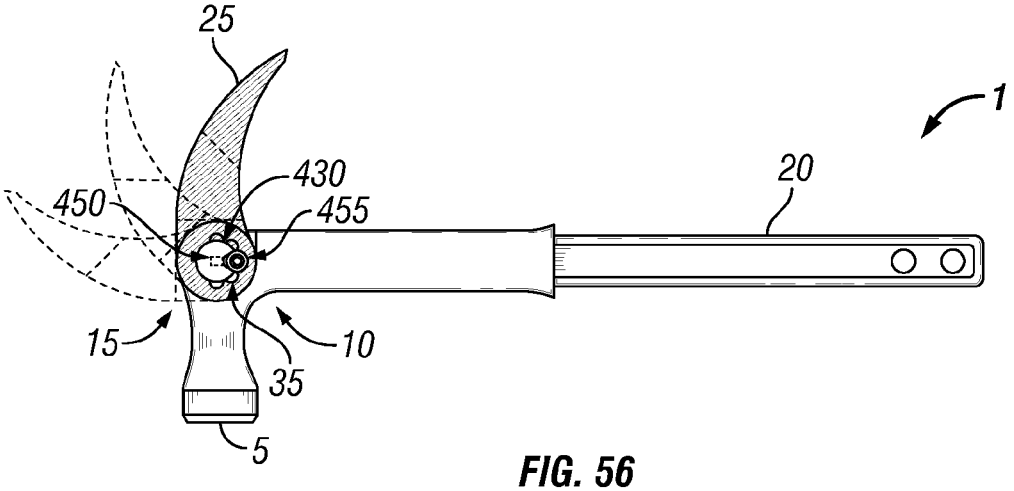
FIG. 56 is a side-view of an embodiment of an adjustable hammer.
Figure 57:
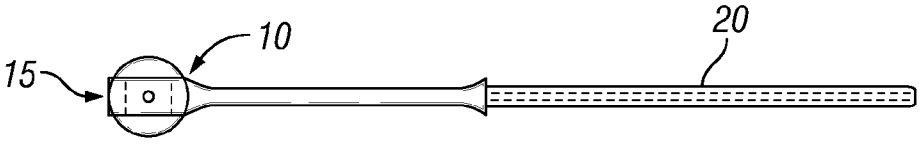
FIG. 57 is a rear-view of an embodiment shown in FIG. 56.
Figure 58:
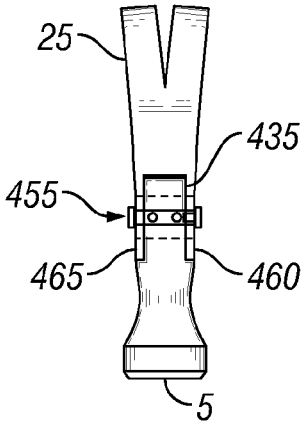
FIG. 58 is an end-view of an embodiment shown in FIG. 56.
Figure 59:
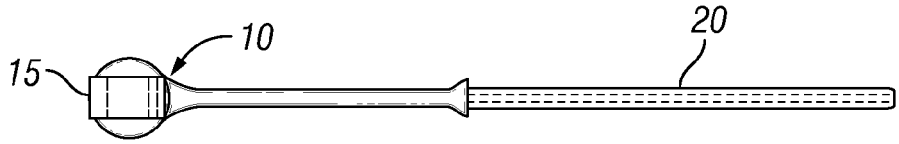
FIG. 59 is a rear-view of a fixed hammer portion of an embodiment shown in FIG. 56.
Figure 60:
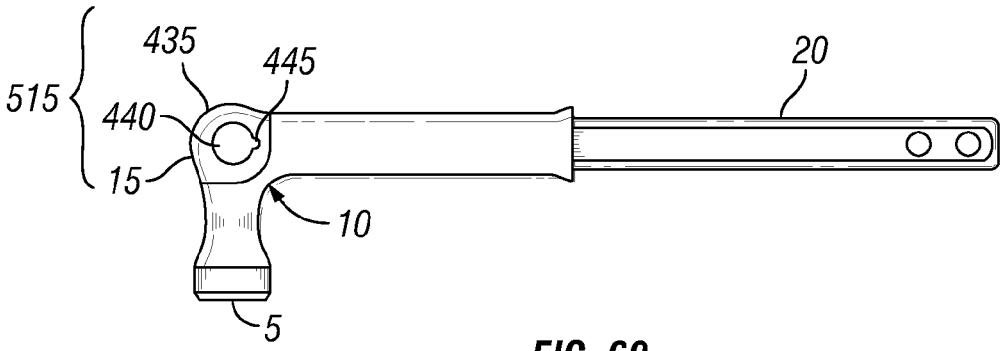
FIG. 60 is a side-view of a fixed hammer portion of an embodiment shown in FIG. 56.
Figure 61:
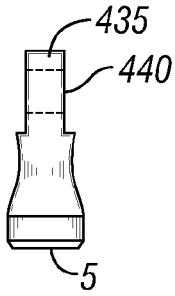
FIG. 61 is an end-view of a fixed hammer portion of an embodiment shown in FIG. 56.
Figure 62:
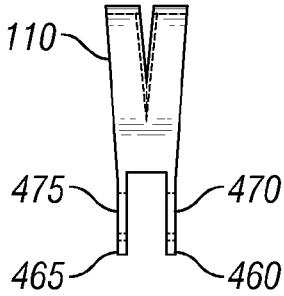
FIG. 62 is an outer curve, end-view of a claw portion of an embodiment shown in FIG. 56.
Figure 63:
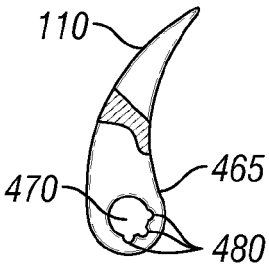
FIG. 63 is a side-view of a claw portion of an embodiment shown in FIG. 56.
Figure 64:
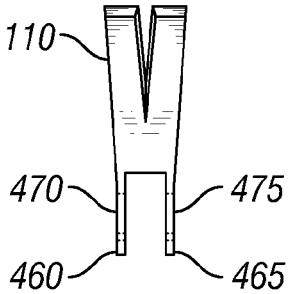
FIG. 64 is an inner curve, end-view of a claw portion of an embodiment shown in FIG. 56.
Figure 65:
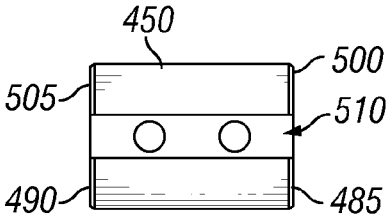
FIG. 65 is a side-view of a pin of an embodiment shown in FIG. 56.
Figure 66:
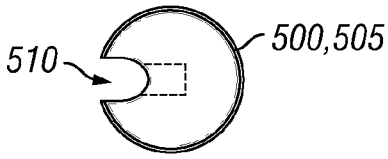
FIG. 66 is an end-view of a pin of an embodiment shown in FIG. 56.
Figure 67:
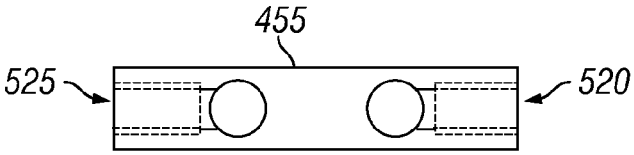
FIG. 67 is a side-view of a locking pin of an embodiment shown in FIG. 56.
Figure 68:
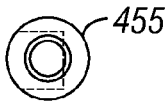
FIG. 68 is an end-view of a locking pin of an embodiment shown in FIG. 56.

As seen in FIGS. 56 and 58, the pivoting mechanism 430 of the seventh embodiment of the present invention comprises a first end 15 of a handle 20 having a striking surface 5, such as a hammer head 10, and a center prong 435, having a circular orifice 440, having a smooth interior circumference adapted with a single spline 445 at an edge of orifice 440 to receive a pin 450 and a locking pin 455, a claw 25 with a v shaped claw portion 110 and a rounded upper 460 and lower prongs 465, each having a substantially centered circular orifice 470 and 475 with a smooth interior circumference adapted with a series of splines 480 and 485 at an edge of orifice 470 and 475 in the upper 460 and lower prongs 465, respectively, to receive a pin 450 and a locking pin 455, the center prong 435 adapted to fit within and rotate with respect to the upper 460 and lower prongs 465. A pin 450, being a substantially solid cylinder with a circumference slightly less than the circumference of the orifices 440, 465 and 470 through which it is inserted and adapted to receive a locking pin 455, is inserted axially through the orifices 440, 470 and 475 of the center 435, upper 460 and lower prongs 465, respectively. Each end 485 and 490 of the pin 450 includes a disk portion 500 and 505 that has a circumference greater than that of the orifices 440, 470 and 475 so as to secure the pin 450 axially within the orifices 440, 470 and 475 and is adapted with a single spline 510 to receive a locking pin 455.

Figure 69:
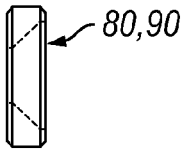
FIG. 69 is a side-view of a retaining cap of an embodiment shown in FIG. 56.
Figure 70:
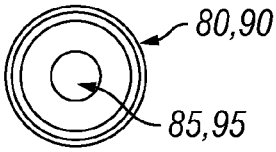
FIG. 70 is an end-view of a retaining cap of an embodiment shown in FIG. 56.

As seen in FIGS. 56, 58, 60, 63-70, a locking mechanism 515 serves to lock the rotating claw 25 with respect to the handle 20. The locking mechanism 515 is comprised of a center orifice 440 located in the center prong 435 adapted with a single spline 445 to receive a locking pin 455, an upper 470 and lower orifice 475, each adapted with a series of splines 480 and 485 to receive the locking pin 455, and a locking pin 455. The locking pin 455, being a substantially solid cylinder with a circumference slightly less than the circumference of the splines 445, 480 and 485 through which it is inserted, is inserted axially through the splines 445, 480 and 485 of the center 440, upper 460 and lower prongs 465, respectively. The locking pin 455 has a bore 520 and 525 at each end of the locking pin 455 and is threaded at both ends. As seen in FIGS. 69 and 70, the locking mechanism 515 further comprises a first retaining cap 80 being circular planar member having a centered, smooth tapered bore 85 therethrough, a first screw with a head to be disposed through the first retaining cap 80 to couple the first retaining cap 80, via the first screw, with one end of the threaded bore 520 of the locking pin 455, a second retaining cap 90 being a circular planar member having a centered, smooth tapered bore 95 therethrough; and a second screw with a tapered head to be disposed through the second retaining cap 90 to couple the second retaining cap 90, via the second screw, with the other threaded bore 525 of the locking pin 455. When the user applies an upward force to the first 80 and second retaining caps 90, the locking pin 455 is caused to be forced upwards toward the edge of the circular cutout 510 in the pin 450 and hence to be unlocked in the splines 445, 480 and 485 of the center 440, upper 460 and lower prongs 465, respectively, in which it is located at that time.

The locking pin 455 is caused to be forced downward into the splines 445, 480 and 485 located on the edge of circular orifices 440, 470 and 475 in the center 435, upper 460 and lower prongs 465, respectively, by springs that are located between the pin 450 and the locking pin 455. The single spline 510 of the pin 450 has a plurality of chamfers perpendicular to the pin 450 adapted to receive an end of a spring, and the side of the locking pin 455 has a plurality of chamfers perpendicular to the locking pin 455 adapted to receive the other end of the corresponding spring in the pin 450. The spring is normally in an extended position and is caused to be compressed by user force so as to cause the locking pin 455 to be released from the splines 445, 480 and 485 located in the center 435, upper 460 and lower prongs 465, respectively. Then, the claw 25 can be rotated with respect to the handle 20. Once the user releases upward force on the release pin 455, the springs cause the locking pin 455 to return to a downward position. If the locking pin 455 is aligned with the splines 445, 480 and 485 located in the center 435, upper 460 and lower prongs 465, respectively, the claw 25 is locked into position. If not, then the locking pin 455 rides along the smooth curved face of the center 435, upper 460 and lower prong 465 until one of the pairs of circular orifices 470 and 475 in the upper 460 and lower prongs 465, respectively, and the locking pin 455 engage.

As seen in FIGS. 71-91, an eighth embodiment of the present invention comprises a bar 540 having a fixed prying surface 545 such as a crow bar 550, as would be used as a prying surface 545 on a second end 565 of a handle 555 and a claw 570 being pivotally coupled to the first end 560 of the handle 555 thereof with an indexable, lockable pivoting mechanism 575 that includes another splined pin assembly 580.

Figure 71:
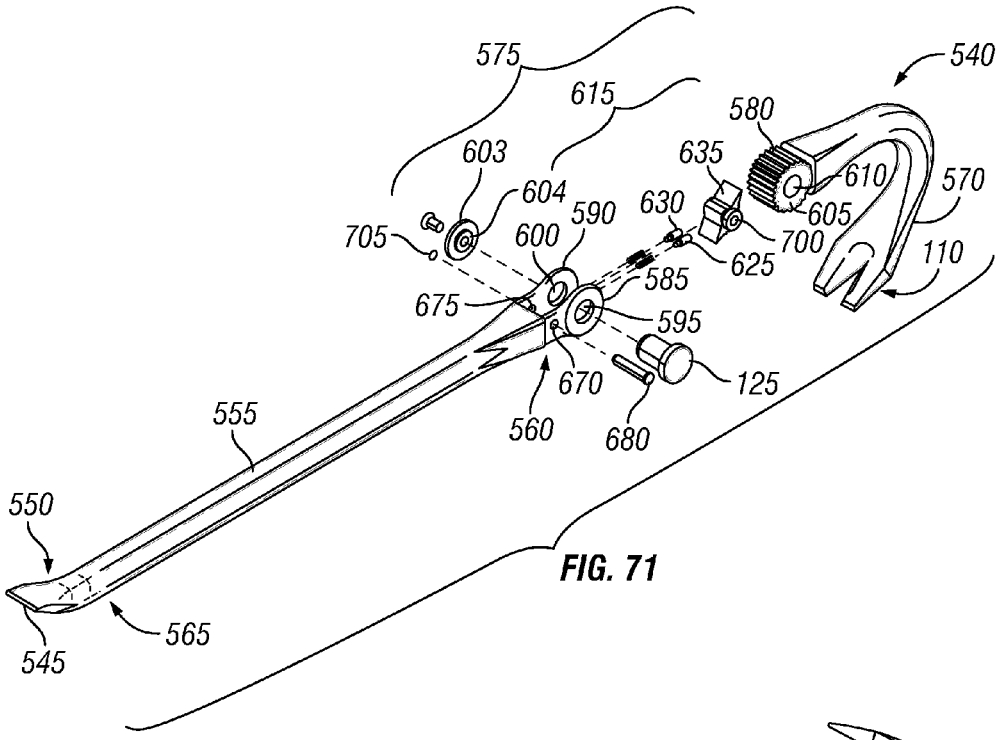
FIG. 71 is an exploded-view of an embodiment of an adjustable crowbar.

As seen in FIG. 71, the pivoting mechanism 575 of the eighth embodiment of the present invention comprises a first end 560 of the handle 555 having a prying surface 545, such as a crow bar 550, an upper prong 585 and a lower prong 590, each having a circular orifice 595 and 600, respectively, having a smooth interior circumference, a claw 570 with v shaped claw portion 110 and a cylindrical center prong 605 having a substantially centered circular orifice 610 with a smooth interior circumference and a partially splined outer circumference, the center prong 605 adapted to fit within and rotate with respect to the upper 585 and lower prongs 590. A pin 125, being a substantially solid cylinder with a circumference slightly less than the circumference of the orifices 610, 595 and 600 through which it is inserted, is inserted axially through the orifices 610, 595 and 600 of the center 605, upper 585 and lower prongs 590, respectively. The first end 130 of the pin 125 includes a disk portion 140 that has a circumference greater than that of the orifices 610, 595 and 600 so as to secure the pin 125 axially within the orifices 610, 595 and 600. Further, the second end 135 of the pin 125 has a pin bore 601 and is threaded at the end of the bore 601. As seen in FIG. 71, the pin assembly 602 further comprises a retaining cap 603 being a circular planar member having a centered, smooth tapered bore 604 therethrough, a first screw with a head to be disposed through the retaining cap 603 to couple the retaining cap 603, via the first screw, with the threaded bore 601 of the pin 125.

Figure 72:
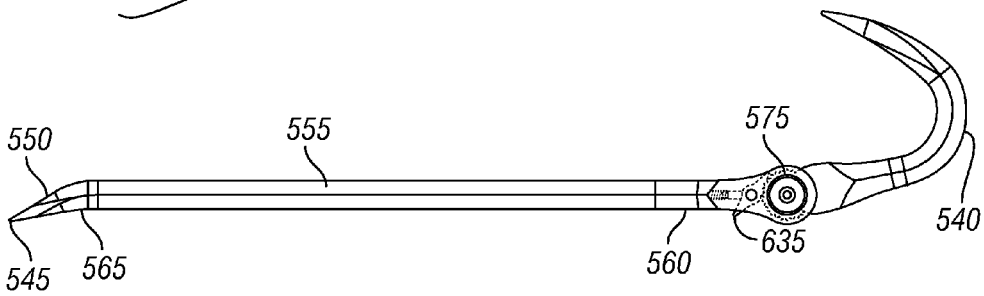
FIG. 72 is a side-view of an embodiment shown in FIG. 71.
Figure 73:
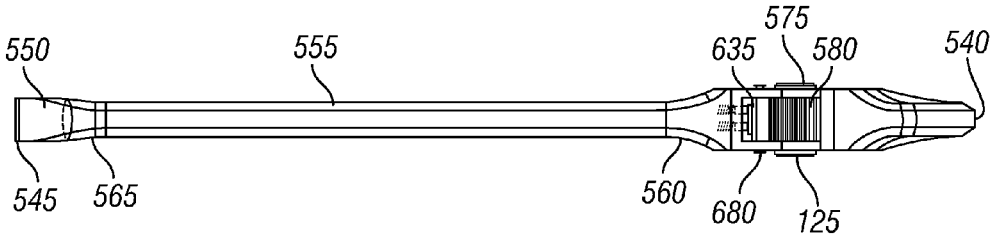
FIG. 73 is a rear-view of an embodiment shown in FIG. 71.
Figure 74:
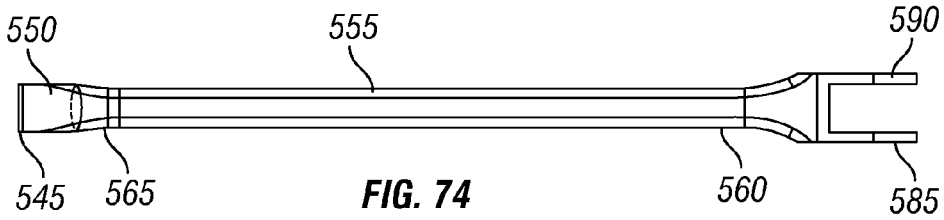
FIG. 74 is a rear-view of a fixed crowbar portion of an embodiment shown in FIG. 71.
Figure 75:
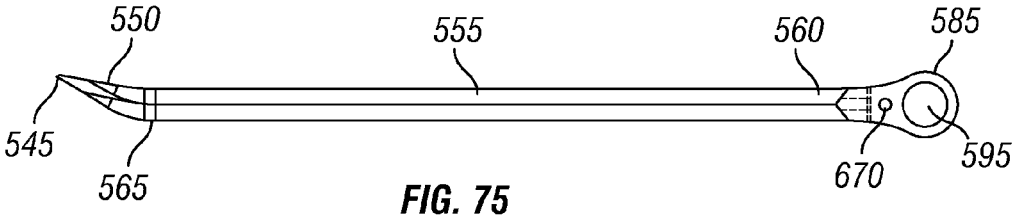
FIG. 75 is a side-view of a fixed crowbar portion of an embodiment shown in FIG. 71.
Figure 76:
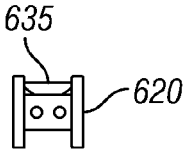
FIG. 76 is an end-view of a fixed crowbar portion of an embodiment shown in FIG. 71.
Figure 77:
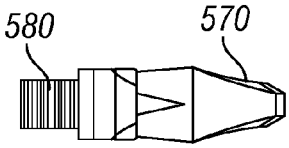
FIG. 77 is an outer curve, end-view of a claw portion of an embodiment shown in FIG. 71.
Figure 78:
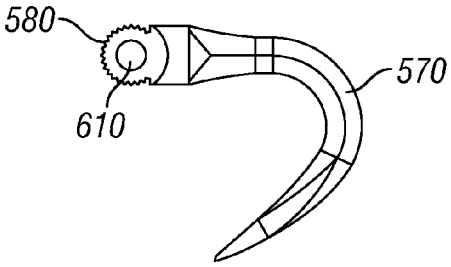
FIG. 78 is a side-view of a claw portion of an embodiment shown in FIG. 71.
Figure 79:
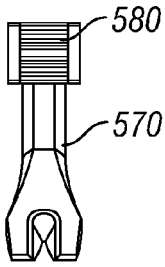
FIG. 79 is an inner curve, end-view of a claw portion of an embodiment shown in FIG. 71.
Figure 80:
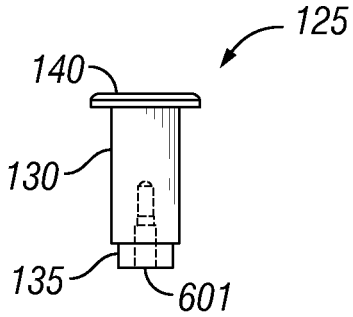
FIG. 80 is a side-view of a pin of an embodiment shown in FIG. 71.
Figure 81:
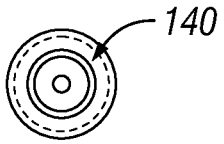
FIG. 81 is an end-view of the pin of an embodiment shown in FIG. 71.
Figure 82:
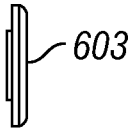
FIG. 82 is a side-view of a retaining cap of an embodiment shown in FIG. 71.
Figure 83:
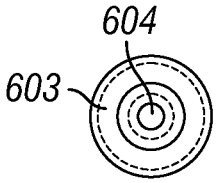
FIG. 83 is an end-view of a retaining cap of an embodiment shown in FIG. 71.
Figure 84:
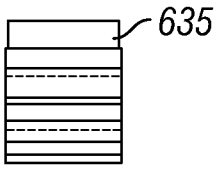
FIG. 84 is a side-view of a locking lever of an embodiment shown in FIG. 71.
Figure 85:
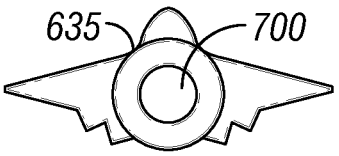
FIG. 85 is an end-view of a locking lever of an embodiment shown in FIG. 71.
Figure 86:
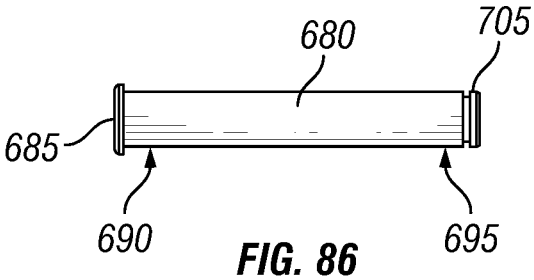
FIG. 86 is a side-view of a locking lever pin of the embodiment shown in FIG. 71.
Figure 87:
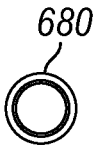
FIG. 87 is an end-view of a locking lever pin of an embodiment shown in FIG. 71.
Figure 88:
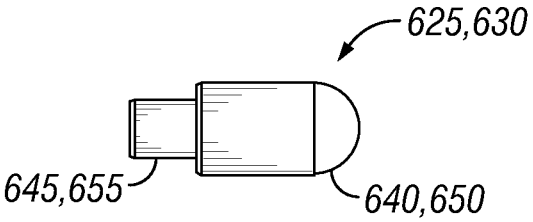
FIG. 88 is a side-view of a locking pin of an embodiment shown in FIG. 71.
Figure 89:
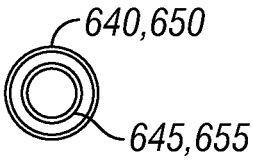
FIG. 89 is an end-view of a locking pin of an embodiment shown in FIG. 71.
Figure 90:
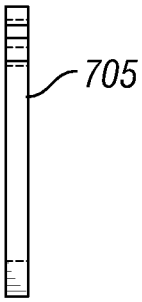
FIG. 90 is a side-view of a retainer ring of an embodiment shown in FIG. 71.

As seen in FIGS. 71-73, a locking mechanism 615 serves to lock the rotating claw 570 with respect to the handle 555. The locking mechanism 615 is comprised of a handle bore 620 located longitudinally within a portion of the handle adapted to receive a plurality of locking pins 625 and 630 for a locking lever 635, the first locking pin 625 having a first end 640 and a second end 645, the first end 640 of the locking pin 625 being tapered and adapted to be in contact with an end of the locking lever 635, the second locking pin 630 having a first end 650 and a second end 655, the first end 650 of the locking pin 630 being tapered and adapted to be in contact with an end of the locking lever 635. The second end of locking pins 625 and 630 have a chamfer adopted to receive an end of a spring.

The locking mechanism 615 further comprises an upper 585 and lower prong 590, each having an upper 670 and a lower locking pin bore 675, a locking lever 635, having a center orifice 700, the locking lever 635 being adapted to fit within and rotate with respect to the upper 585 and lower prongs 590. A locking lever pin 680 being a substantially solid cylinder with a circumference slightly less than the circumference of the orifices 700, 670 and 675 through which it is inserted, is inserted axially through the orifices 700, 670 and 675 of the locking lever 635 and the upper 585 and lower prongs 590, respectively. Further, the locking lever pin 680 has a first end 690 and a second end 695, the first end of the locking lever pin 680 has a disk 685 and the second end has a retainer ring 705. The locking lever 635 is adapted to permit a user to apply downward force to an end of the locking lever 635 contacting the locking pins 625 and 630 thus causing the locking pins 625 and 630 be forced downward.

The locking pins 625 and 630 are caused to be forced upward into the locking lever 635 by springs that are located below the locking pins 625 and 630 within the handle bore 620. The second ends 645 and 655 and of the locking pins 625 and 630, respectively, have chamfers adopted to receive an end of the springs. The springs are normally in an extended position and is caused to be compressed by user force so as to cause splines on the locking lever 635 to be released from splines on the cylindrical center prong 605. Then, the claw 570 can be rotated with respect to the handle 555. Once the user releases the downward force on the locking lever 635, the springs cause the locking lever 635 to return to an upward position. If the splines on the locking lever 635 are aligned with splines on the center prong 605, the claw 25 is locked into position. If not, then the splines of the locking lever 635 ride along the splined surface of the center prong 605 until a plurality of splines on the center prong bore 605 and the splines of the locking lever 635 engage.

Figure 91:
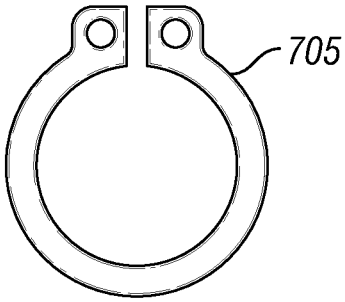
FIG. 91 is an end-view of a retainer ring of an embodiment shown in FIG. 71.

As seen in the preferred embodiments of FIGS. 1-91, it will be readily apparent that various changes and modifications could be made to the hammer and/or crowbar therein without departing from the scope of the invention.

What is claimed is:

1. A hand tool, comprising:

a fixed tool with respect to a handle, wherein a first end of the handle has an upper prong and a lower prong, wherein each prong has a circular orifice having a smooth interior circumference there-through;

a pivoting mechanism;

a locking mechanism, wherein the locking mechanism further comprises a rotating locking lever assembly adapted to permit the locking lever to pivot with respect to the handle and to lock the claw with respect to the handle, wherein at least two opposing locking lever portions and a rounded center prong have a substantially centered orifice there-through with a smooth interior circumference, wherein the rotating locking lever is adapted to fit within and rotate with respect to the upper and lower prongs;

a locking lever pin, wherein the locking lever pin is a substantially solid cylinder with a circumference slightly less than the circumference of the orifices through which it is inserted, wherein the locking lever pin is inserted axially through the orifices of the locking lever and the upper and lower prongs, wherein at least one end of the locking lever pin is adapted to receive a retainer ring that has an outer circumference greater than that of the orifices so as to secure the locking lever pin axially within the orifices; and a claw, wherein the claw is coupled to the handle via the pivoting mechanism.

2. The hand tool of claim 1, wherein the fixed tool has a fixed striking surface with respect to a handle.

3. The hand tool of claim 1, wherein each end of the locking lever pin includes a disk portion that has a circumference greater than that of the orifices so as to secure the locking ever pin axially within the orifices.

4. The hand tool of claim 1, wherein the fixed tool has a fixed prying surface with respect to the handle.

5. The hand tool of claim 4, wherein the prying surface further comprises a fixed crowbar head and wherein the claw is indexable and lockable with respect to the crowbar head.

6. The hand tool of claim 4, wherein the prying surface further comprises a fixed crowbar head and wherein the claw is indexable and lockable with respect to the handle.

7. The hand tool of claim 3, wherein the fixed tool has a fixed prying surface with respect to a handle.

8. The hand tool of claim 1, wherein the claw has a v shaped claw portion and a rounded center prong having a substantially centered circular orifice there-through with a smooth interior circumference, wherein the center prong is adapted to fit within and rotate with respect to the upper and lower prongs;

wherein each end of the locking lever pin includes a disk portion that has a circumference greater than that of the orifices so as to secure the locking lever pin axially within the orifices.

9. The hand tool of claim 1, wherein the locking mechanism further comprises:

a handle bore located longitudinally within a portion of the handle adapted to receive at least two locking pins for the rotating locking lever, wherein a first end of the locking pin is adapted to be in contact with an end of the rotating locking lever and a second end of the locking pin is adapted to receive an end of a spring.

* * * * *